United States Patent [19]

Scott et al.

[11] Patent Number: 4,901,775

[45] Date of Patent: Feb. 20, 1990

[54] AUTOMATIC SEAL MACHINE FOR BANK BAGS AND THE LIKE

[75] Inventors: Ernest D. Scott, Delray; Gregory W. Scott, Jacksonville Beach, both of Fla.; Donald L. Tedder, Carrollton, Ga.

[73] Assignee: Edge Technology Corporation, Boca Raton, Fla.

[21] Appl. No.: 303,463

[22] Filed: Jan. 30, 1989

[51] Int. Cl.[4] ..... B21F 09/02

[52] U.S. Cl. ..... 140/123.5; 140/150; 254/231

[58] Field of Search ..... 140/93 A, 93.2, 123.5, 140/123.6, 150; 101/31.5; 254/231, 236

[56] References Cited

U.S. PATENT DOCUMENTS 1,396,229 11/1921 Neth ..... 254/231

2,600,394 6/1952 Conklin ..... 140/123.5

4,371,010 2/1983 Hidassy ..... 140/123.6

*Primary Examiner*—Lowell A. Larson

*Attorney, Agent, or Firm*—Malin, Haley, McHale, DiMaggio & Crosby

[57] ABSTRACT

A hand-held apparatus for tensioning a bundling strap about an item to be bundled having a motor and a rotatable output shaft coupleable to one end of an elongated external screw threaded shaft supported for rotation at its opposite end by an end cap. A guide block is adapted for linear reciprocal movement along the shaft between the hand-held unit and the end cap and has threads corresponding to screw threads on the shaft, the guide block having connected thereto means for gripping the bundling strap. A reversible power means energizes the hand-held unit and reverses or halts the direction of rotation of the output shaft upon exertion of a predetermined force upon the guide block.

7 Claims, 4 Drawing Sheets

AUTOMATIC SEAL MACHINE FOR BANK BAGS AND THE LIKE

BACKGROUND OF THE INVENTION

1. Field of the Invention

This invention relates generally to an automatic means for drawing a bundling strap around an article to be protected, such as the neck of a coin bag, and more particularly relates to a novel, automatic bundling means for rapidly securing a bundling strap about the neck of a coin bag or other item(s) to be secured together using a reciprocally linearly moving gripping means to pull the bundling strap taut.

2. Prior Art

It is well known in the banking industry to utilize a self-clinching bundling strap to secure closed the neck of a currency bag. A representative example of such a strap is shown in U.S. Pat. No. 3,186,047 to Schwester et al. Devices for securing these straps about the neck of a bank bag or other item to be bundled have heretofore been exclusively manually operable and cumbersome. These devices have primarily been hand-operated seal presses utilizing a fabric-type cord secured in taut relationship about the neck of the currency bag by means of a quantity of lead which is crimped by the hand-operated seal press and thereby deformed, forming a tight grip about said cord. An example of this type of hand-operated seal press is embodied in U.S. Pat. No. 3,911,970 to Lundberg et al. The process of bundling the neck of a currency bag using these hand-operated devices is extremely time consuming.

It is therefore a principal object of the present invention to provide a means for automatically and rapidly securing a self-clinching bundling strap about the neck of a currency bag or other items to be bundled.

It is a further object of the present invention to provide a machine for automatically tightening a bundling strap about the neck of a currency bag which is lightweight and accomplishes its task consistently and a multiple of times faster than the heretofore hand-operated devices.

SUMMARY OF THE INVENTION

This invention provides a hand-operated automatic machine means for pulling taut to a predetermined tension a self-clinching bundling strap about an article to be protected such as the neck of a currency bag. The machine means is comprised generally of a means for rotating an output shaft, as for example a hand-held electric screwdriver motor and hand-held housing unit therefore having associated therewith an on/off switch normally biased to the "off" position, said output shaft being coupled to an externally threaded rod which is disposed to rotate about its elongate axis by means of a bearing means at the end of said rod opposite the coupling with said output shaft. An internally threaded guide block means is disposed for linear reciprocal movement along the elongate length of said externally threaded rod. Means for gripping the body portion of said strap are rotatably associated with said guide block means. As said threaded rod rotates, the threads thereon rotate, causing the guide block means to move linearly by virtue of the meshing interconnection of the rod threads with the internal threads of the guide block means. The strap body is brought into engagement with said gripping means. Thereafter, movement of said guide block means away from said currency bag causes said gripping means to firmly engage and roll mark said strap body and pull said strap body taut to a predetermined tension.

The shaft/gripping means arrangement is positioned within a protective housing means which corresponds generally with the elongate axis of said rod and connects to the output shaft-end of said hand-held reversible motor housing unit to form one integral unit therewith.

It should be noted that for purposes of this disclosure, "distal" shall mean toward the left in the figures and "proximal" shall mean toward the right in the figures.

The distal end of said housing means defines an aperture corresponding generally to the shape of the body portion of said bundling strap so that the tail-end of said bundling strap may be passed through said aperture and placed into locking engagement with said gripping means, which gripping means is positioned at the distal end of said rod when the sealing operation is commenced. The machine means is then actuated, the output shaft and rod begin to rotate, which thereby causes the gripping means to move linearly toward said machine means and away from said currency bag, thereby pulling the bundling strap along with it because of frictional interconnection between said gripping means and the strap body. The bundling strap has already been placed about the open neck of a currency bag or other item(s) to be bundled. The gripping means is drawn backwardly along said rod so as to pull the bundling strap tightly through the head end portion of said strap and around the neck of the currency bag or other item(s) to be bundled. Self-clinching means are provided within the bundling strap as is known in the art so that the strap will remain tight about the bundled bag without loosening. As the self-clinching means within the bundling strap may be exposed to tampering by someone attempting to gain unauthorized access to the interior of said bag, security cap means may be provided for surrounding the head-end portion of the bundling strap wherein is located the self-clinching means. The self-clinching means may be, for example, a semi-rigid sharp projection which engages the body of the tautly pulled bundling strap against reverse (or loosening) movement.

The hand-held unit is provided with a power means having adjustable automatic shut-off and reverse direction features which are actuated when the gripping means fully reaches both the proximal and distal ends of said threaded rod or when it reaches said predetermined tension so as to avoid producing undue stresses within the invention as a whole or any of its components.

In accordance with these and other objects which will be apparent hereinafter, the instant invention will now be described with particular reference to the accompanying drawings.

DETAILED DESCRIPTION OF THE PREFERRED EMBODIMENT

Figure 1:
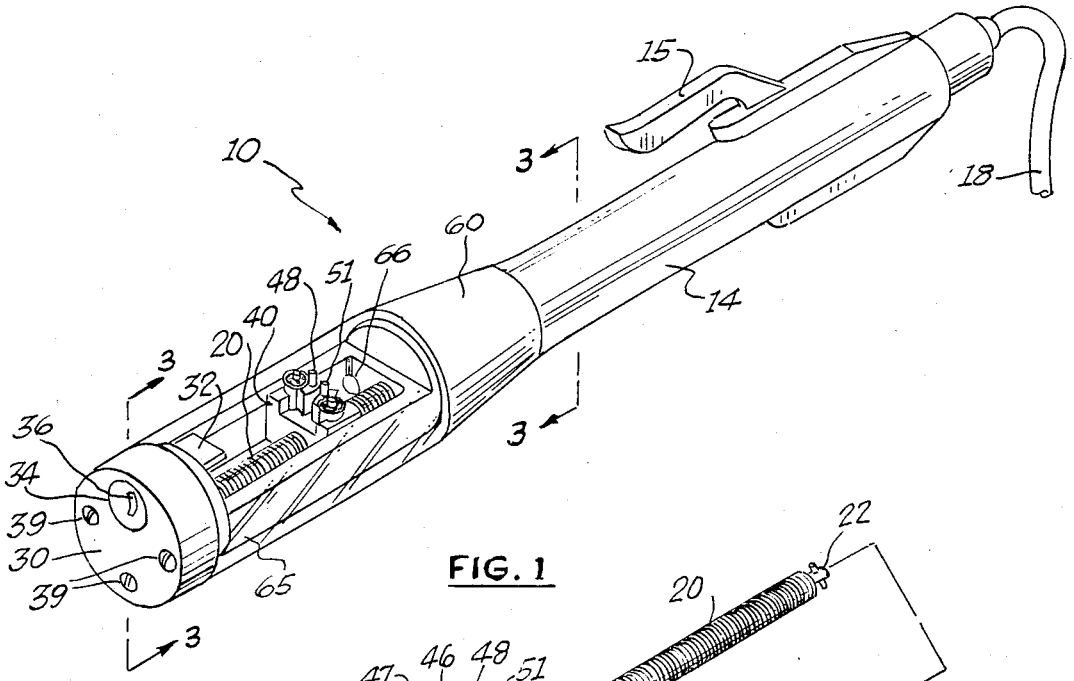
FIG. 1 is a perspective view of the invention.

Referring now specifically to the drawings, reference numeral 10 designates the automatic seal machine which is comprised of a hand-held unit 14 housing a reversible motor means (not shown) having a rotating output shaft 16. The motor means is preferably actuatable by a normally open on/off switch 15. The motor is powered and controlled logically by a remote controller unit 80, to be described more fully hereinafter. Remote controller 80 is electrically communicated to said automatic seal machine 10 by means of an electrical cable 18 or the like. Pin connectors or other suitable electrical connecting means 82 may be employed to communicate cable 18 with the motor means and with remote controller unit 80.

Figure 3:
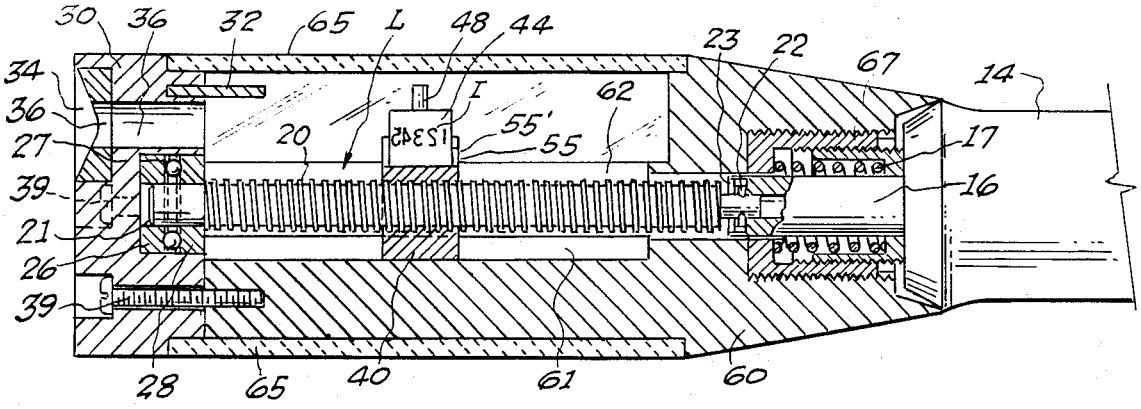
FIG. 3 is an elevational cross-sectional view of the assembled hand-held tool taken along lines 3—3 of FIG. 1.

Output shaft 16 of said motor means is coupleable to a rotatable threaded elongated rod 20, preferably by means of a transverse pin 22 which is sized and shaped to engage a corresponding detant 23 disposed within the end of output shaft 16, as best shown in FIG. 3.

Figure 2:
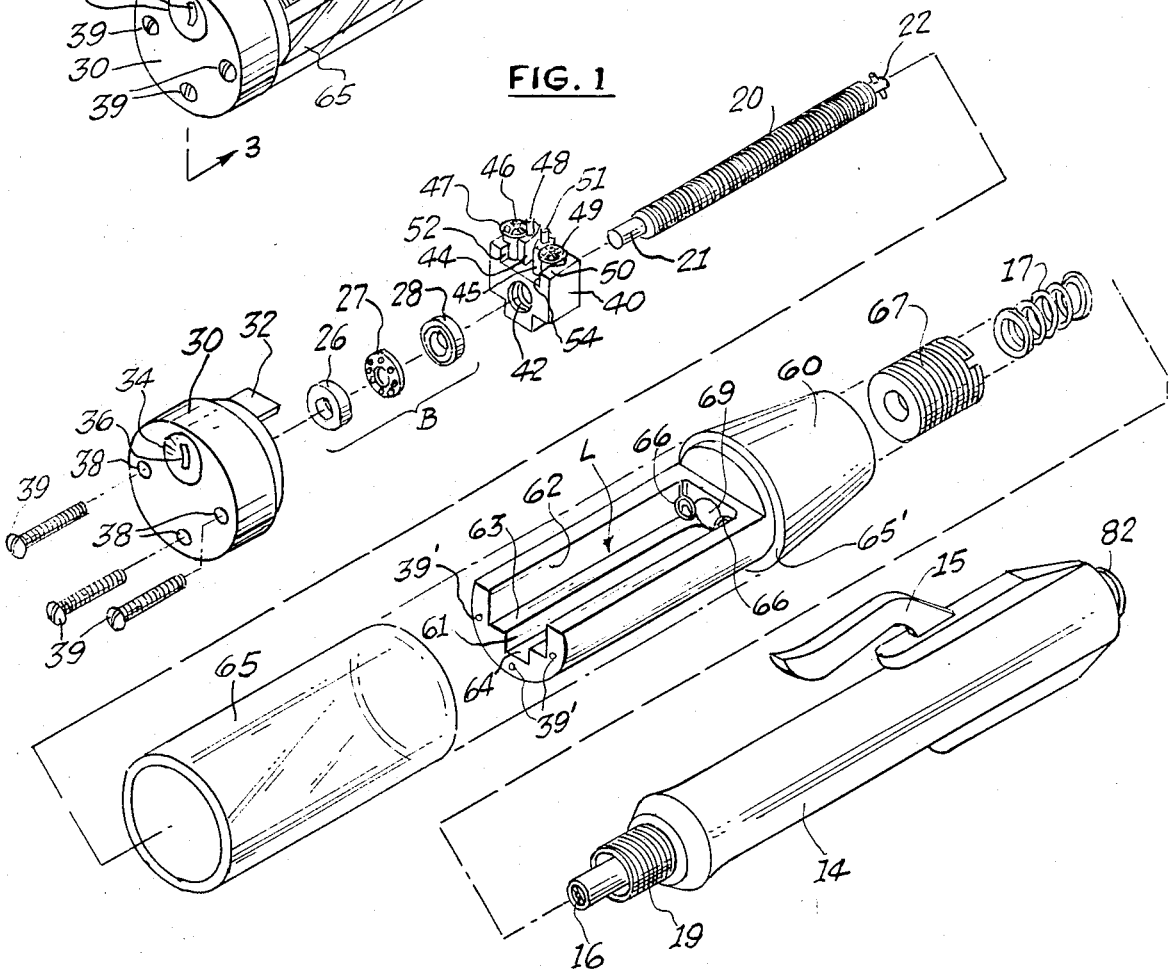
FIG. 2 is an exploded view of the invention showing the interior details.
Figure 4:
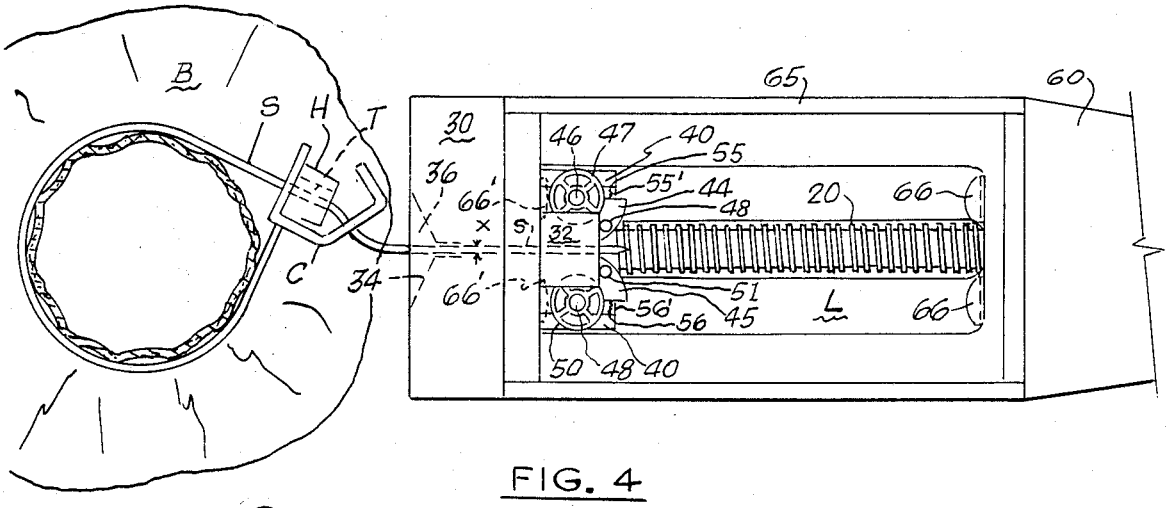
FIG. 4 is a plan view of the assembled hand-held tool shown in FIG. 3, where the bundling strap is inserted into the gripping means but not yet pulled tightly about the neck of a currency bag.
Figure 5:
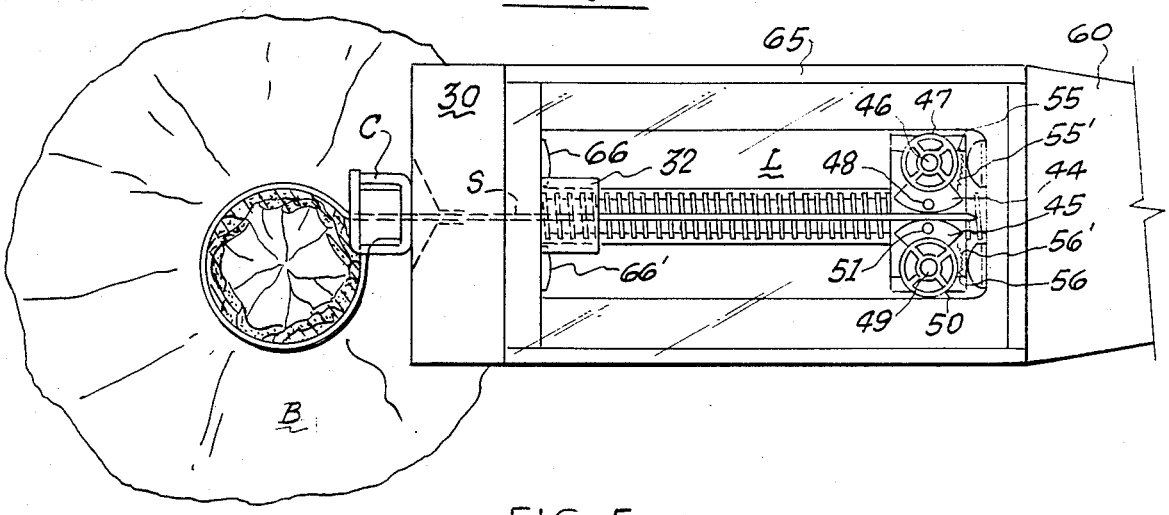
FIG. 5 is a plan view of the assembled hand-held tool where the bundling strap has been pulled tightly about the neck of the currency bag.

Referring now to FIGS. 1 & 2, hand-held unit 14 is provided with external threads 19 at its distal end which are adapted to engage in mating contact an internally threaded collar 16 within shaft housing 60. Housing 60 is configured to generally surround the apparatus of the strap tensioning mechanism in a manner which will be set forth herein. Housing 60 is comprised of a generally cylindrical shaped body portion, which may have a tapering proximal end portion. Housing 60 is adapted to join hand-held unit 14 in threading engagement at threads 19. Sandwiched therebetween is slip-clutch spring 17 which provides compressive force against a slip-clutch mechanism disposed within hand-held unit 14 in a conventional manner. In the preferred embodiment, internally and externally threaded collar 67 mates housing 60 with threads 19 of hand-held unit 60. Spring 17 contacts collar 67 at the distal end thereof. The position of collar 67 within housing 60 is adjustable by turning said collar 67 either clockwise or counterclockwise when viewed from its proximal end depending upon whether it is desired to increase or decrease the force exerted by spring 17 between housing collar 67 and hand-held unit 14. Increasing the force borne by spring 17 increases the pressure on the hand-held unit motor slip clutch (not shown) which in turn increases the amount of tensioning force which said motor can exert on a bundling strap being tensioned before said slip clutch will fail to provide any gripping force and allow the motor in unit 14 to spin free. In an alternative embodiment, the adjustment feature of collar 67 would be replaced by interchangeable springs 17 having differing spring constants. Housing 60 has cut out therefrom a generally Y-shaped channel L conforming to the elongate length of housing 60 and comprised of a lower floor portion 64, adjoining lower vertical walls 61, a pair of upper floors 63 and upper vertical walls 62. At the proximal and distal ends of said channel L may be positioned a pair of resilient damping members 66 and 66', respectfully. Surrounding said elongated channel L is a cylindrical safety collar member 65 adapted to fit snugly about the exterior of housing H, the proximal end thereof adapted to engage a raised shoulder portion 65, of housing body 60 in abutting relationship. Threaded screw or bolt openings 39' are disposed in the distal end of housing body 60. Housing body 60 has a bore 69 through its proximal end along the central axis thereof through which passes the proximal end of rod 20. The distal end of rod 20 adapted to ride in free spinning association within a bearing means B. Bearing means B may be comprised of a pair of ball bearing race members 26 and 28 sandwiching a series of lubricated ball bearings enclosed within a disk shaped collar 27. Said bearing means B is centrally disposed within the proximal end of end cap means 30. End cap means 30 is removably connected to housing 60 by way of fastening means. Said fastening means are preferably comprised of a series of screws or bolts 39 disposed through openings 38 in end cap 30 for threading engagement with threaded openings 39, in housing body 60. In this way end cap means 30 is rigidly connectable to hand-held unit 14. When assembled, as shown in FIGS. 1 and 3, screws 39 are threaded into openings 39, in housing 60, which thereby sandwiches collar 65 between the proximal end of housing 60 and end cap 30. In this manner, the rod 20 and strap gripping means may be viewed readily. Disposed within end cap 30 is a seal follower 34 having an aperture 36 therein sized and shaped to correspond to the width and thickness dimensions of the body of a bundling strap S, as best shown in FIGS. 4 and 5. Attached to the upper proximal end of end cap 30 is a rectangular plate or cam opener 32 which is disposed generally directly above aperture 36. Said cam opener 32 is designed to release the gripping means, to be discussed below, after the bundling strap tensioning operation is completed.

Slidably disposed within channel L of housing 60 is means for gripping said bundling strap body S and for tensioning said bundling strap about the neck of a bank bag or other item(s) to be bundled. The gripping means is comprised, in the preferred embodiment, of a guide block 40 corresponding generally to the shape of channel L having disposed therethrough an internally threaded bore adapted to engage the threads of shaft 20 in mating association.

Guide block 40 has associated therewith at its upper end a pair of spaced apart shear pins 46 and 49 adapted to act as rotating axes for a pair of partially rotatable cam members 44 and 45, respectively. Said cam members have a pair of opposed facing surfaces spaced apart a distance slightly greater than the thickness of strap body S measured in the direction indicated by the letter x shown in FIG. 4 when said cam members 44 and 45 are in the open position shown in FIGS. 1 and 4. Cam members 44 and 45 move in a cam action manner so that their opposed strap gripping faces are closer together when in the closed position shown in FIG. 5 than they are when in the open position shown in FIG. 4. In this way, said cam members squeeze strap S when moved from their open toward their closed position. Cam members 44 and 45 have connected thereto a pair of cam opener contact pins 48 and 51, respectively, adapted to contact cam opener 32 after a tensioning operation is performed. Cam members 44 and 45 each have disposed therein a bore through which are passed said shear pins 46 and 49, leaving said cam members 44 and 45 free to rotate about said shear pins 46 and 49, respectively. Cam members 44 and 45 are free to rotate on shear pins 46 and 49, respectively, only to the extent allowed by surfaces 52 and 54 in one direction and surfaces 55 and 56 of guide block 40, as best shown in FIGS. 3 through 5. In this manner, during the tensioning operation that occurs between FIGS. 4 and 5, cam members 44 and 45, respectively, are rotated by virtue of the frictional interconnection between said cam member and the strap body S until they abut surfaces 52 and 54, respectively. Conversely, after the tensioning operation is carried out, the direction of rotation of rod 20 is reversed, causing guide block 40 to traverse from the proximal end to the distal end of said rod 20. Once cam opener contact pins 48 and 51 are brought into contact with cam opener 32, cam members 44 and 45 are forced to rotate in the opposite direction from that above identified, thereby relieving the frictional interconnection between said cam members 44 and 45 and strap body S. Surfaces 55 and 56 are employed, therefore, to limit the amount of rotation of cam members 44 and 45 brought about by cam opener 32.

A pair of springs 55' and 56' are connected to cams 44 and 45 which act on guide block 40 at surfaces 55 and 56 to maintain cam members 44 and 45 in a predetermined, partly closed, position so that they may receive a new strap S prior to each tensioning operation without binding. Equal springs on both surfaces 55 and 56 assures that cam members 44 and 45 will receive the new strap body S under equal force conditions so that each said cam member will exert equal frictional and compressive forces on strap body S.

Retaining rings 47 and 50 may be employed to fix cam members 44 and 45 in rotatable association with guide block 40, as best seen in FIGS. 2, 3, and 4.

Control unit 80 is electrically connected to hand-held unit 14 by a conductive cable 18. A pin connection means 82 is preferably employed to electrically connect cord 18 with the electronic circuitry within control unit 80 and with unit 14. However, other suitable electrical connecting means may be employed such as direct wiring, ribbon cable connection, or other appropriate means of connection.

Figure 6:
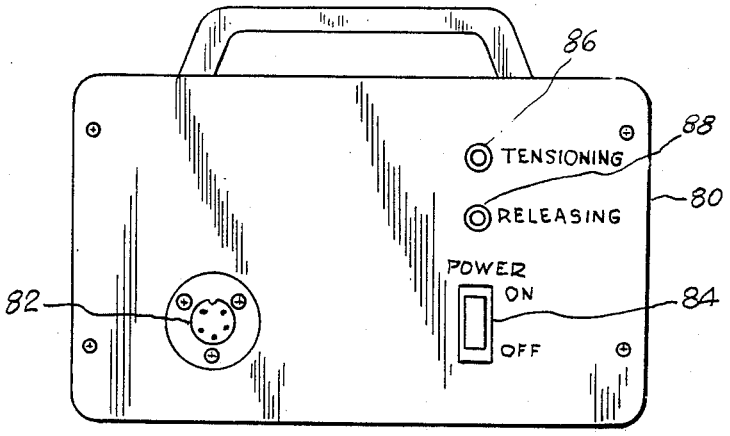
FIG. 6 is a front elevational view of a housing for a power and direction control means.
Figure 7:
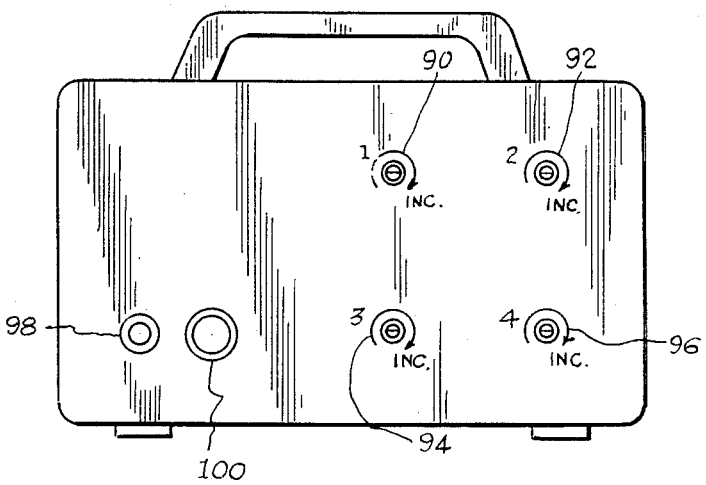
FIG. 7 is a rear elevational view of a housing for a power and direction control means.
Figure 8:
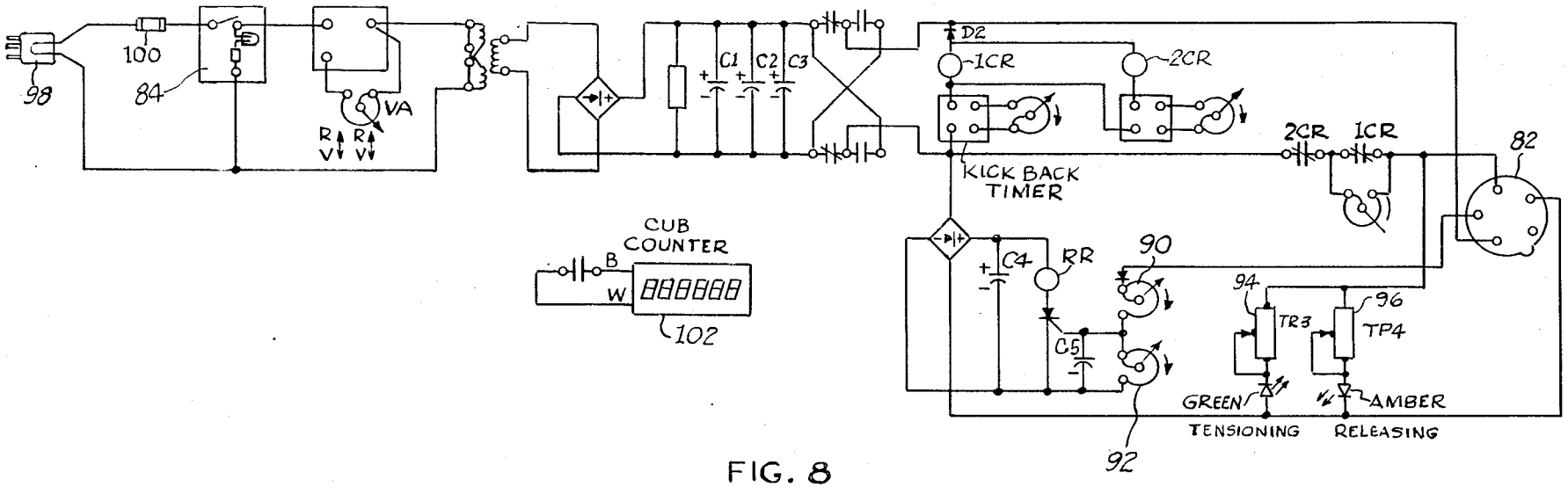
FIG. 8 is a schematic diagram of the power and direction control means.

As best shown in FIGS. 6 through 8, control unit 80 is provided with an on/off switch 84, tensioning operation indicator light 86 and releasing operation indicator light 88. Power from a remote source such as a wall outlet is provided through opening 98 on the reverse side thereof, shown in FIG. 7. Protection against power surges or other electrical malaise may provided in the form of a fuse or fuseable link 100. Means for adjusting the operational characteristics of the strap tensioning device 10 are provided by variable timers 90 and 94 and variable resistors 92 and 96. A digital display (not shown) may be provided to indicate the tensile force exerted by the gripping means on the strap S. Tensile forces generated in strap S are dependent upon and are a function of the adjustment of adjusting means 92 and 96.

Timer 90 may be referred to as a reverse mode kick-back timer which causes a delay between the time the motor means is disabled and the time it is re-enabled, as when the direction of rod 20 is reversed. Such a reversal occurs when it is desired to change the direction of movement of guide block 40. For example, as shown in FIG. 4, to begin the tensioning operation, strap body S is placed between cam members 44 and 45, at which time guide block 40 is at the distal end of rod 20. Thereafter the motor means is energized by the circuit of FIG. 8 causing rod 20 to rotate in the counter-clockwise direction when viewed from the distal end of rod 20, thereby causing guide block means to move from the left to the right of FIG. 4. This movement simultaneously causes cam members 44 and 45 to rotate into abutting engagement with surfaces 52 and 54, respectively, thereby frictionally engaging strap body S and pulling it along at the same speed and in the same direction of travel as guide block 40. This causes security cap C, which is pre-positioned around strap head end H, to be moved into abutting engagement with seal follower 34 and to thereby close tightly and securely about end H. Score lines F are cut into the bends in cap C, as shown in FIGS. 4 and 5 so as to weaken each said bend wherein prying open said cap C causes a fracture, thus giving a clear indication of tampering. Once a cap C ruptures at any score line F, it can no longer be used as a security cap. Continued movement of guide block 40, and hence cam members 44 and 45, pulls strap S into tight bundling position about the neck of currency bag A. Upon a predetermined load being exerted by strap S on cam members 44 and 45, and hence guide block 40, which load is also thereby exerted against the rotation of rod 20, motor means is disabled by the circuit shown in FIG. 8 and instantaneously re-energized in the opposite direction, thereby causing shaft 20 to rotate in the clockwise direction when viewed from its distal end. This will cause guide block 40 to travel from right to left in FIGS. 4 and 5 until cam opener 32 contacts cam opener contact pins 48 and 51, causing cam members 44 and 45 to come into abutting contact with surfaces 55 and 56, respectively. When this occurs, the load exerted by guide block 40 on rod 20 causes motor means to be reversed by the circuit of FIG. 8 according to the adjustment of variable resistor 96. If the predetermined load required to disable the motor means is not reached, an adjustable reverse mode maximum cycle timer 94 will cause the motor means to be disabled after a predetermined, brief, time to avoid burning out the motor means if the operator were to maintain power to the hand-held unit after the sealing process was completed.

Generally, with respect to the guide block 40, the sealing process is comprised of movement from its position shown in FIG. 4 to its position shown in FIG. 5 and then back again to its position shown in FIG. 4. It is preferred that the operator apply a modest withdrawal force on strap S while guide block 40 moves from its position shown in FIG. 5 back to its position shown in FIG. 4 so as to avoid any binding of strap S within channel L.

The speed of rotation of shaft 20 and hence of guide block 40 in moving from left to right in FIG. 4 during the beginning of the sealing operation is adjustable by way of adjustable resistor 92. In this manner, the seal tension may be increased or decreased by increasing or decreasing the output voltage applied to the motor means. Thus, the point in which the movement of guide block 40 changes can be adjusted by adjusting resistor 92. The approximate operating voltage is, in the preferred embodiment, 24 volts DC causing output shaft 16 to rotate at approximately 1600 RPM.

It should be noted that the reverse mode kick-back timer adjustment means 90 is preferred so as to overcome the instantaneous start-up torque in the reverse direction immediately following the pre-set maximum tension in strap S having been reached. In everyday use, an automatic seal machine of the nature disclosed herein may be called upon for substantially constant operation. Therefore, controller logic the same as or similar to that disclosed herein is preferred so that the effect of variations in performance of the invention and its components may be minimized such as bank bag size, strap S thickness and strength, and temperature.

Indicia means for identification I may be associated with cam members 44 or 45 for imprinting identifying indicia on strap S, as, for example, a code or name of a financial institution. Said indicia means is preferably different for each additional machine 10. Further, indicia means (not shown) may be used in association with member 34 which would imprint a code or name on security cap C as well. In this manner, indicia means I appears on both strap body S and security cap C when enclosing a bag A so that even if one managed to open cap C and gain access to the contents of bag A, cap C is destroyed and a new cap cannot be imprinted with the identical indicia as appeared originally unless the thief had access to the seal machine originally used, which is unlikely.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. An apparatus for tensioning a bundling strap about an item to be bundled, comprising:

(a) a reversible hand-held unit having a motor and a rotatable output shaft means coupleable to one end of an elongated external screw threaded shaft supported for rotation at its opposite end by an end cap means;

said end cap means being integrally connected to said handheld unit;

(b) a guide block means adapted for linear reciprocal movement along said shaft between said hand-held unit and said end cap means and having threads corresponding to screw threads on said shaft, said guide block means having connected thereto means for gripping said bundling strap;

(c) power means for energizing said hand-held unit and reversing or halting the direction of rotation of said output shaft means upon the exertion of a predetermined force upon said guide block.

2. The apparatus of claim 1, wherein:

said bundling strap is comprised of a head-end portion and a body portion having a length, width and thickness;

said end cap means is comprised of cap housing member having a bearing means for receiving said opposite end of said threaded shaft in free-rotating association and further defining an aperture adapted to receive the body portion of said bundling strap in registry with said gripping means.

3. The apparatus of claim 2, wherein:

said gripping means is comprised of a pair of pivotable jaw members each disposed for partial rotation atop said guide block means, rotatable between a closed, strap gripping, position and an open, strap releasing or receiving, position;

wherein when said jaw members are in the closed position, they are spaced apart by a distance slightly smaller than the thickness of said strap body.

4. The apparatus of claim 3, wherein:

at least one of said jaw members has associated therewith a strap body contacting surface, said surface having strap identification indicia means thereon for imprinting said strap body with identifying indicia.

5. The apparatus of claim 4, further comprising second indicia means adapted to be imprinted on or near said head-end portion.

6. The apparatus of claim 5, wherein said second indicia means is integrally connected to said end cap means.

7. The apparatus of claim 1, wherein:

said power means is comprised of a power supply and circuitry for controlling the operation of the motor of said hand-held unit, said power supply being disrupted and re-energized by variations in the retarding torque exerted on said motor by forces exerted on said guide block means.

* * * * *